United States Patent [19]

True

[11] 4,433,448

[45] Feb. 28, 1984

[54] POWER PIPE THREAD CLEANER

[75] Inventor: Martin E. True, Houston, Tex.

[73] Assignee: Weatherford/Lamb, Inc., Houston, Tex.

[21] Appl. No.: 419,119

[22] Filed: Sep. 16, 1982

[51] Int. Cl.[3] ..... B08B 9/02

[52] U.S. Cl. ..... 15/88; 15/22 R; 15/104.04; 15/104.05

[58] Field of Search ..... 15/88, 104.04, 104.03, 15/22 R, 104.05; 118/DIG. 10, DIG. 11, DIG. 13, 72

[56] References Cited

U.S. PATENT DOCUMENTS

| | | | |
|---|---|---|---|
| 2,635,393 | 4/1953 | Barth | 15/88 X |
| 4,011,617 | 3/1977 | Toelke et al. | 15/88 |
| 4,014,062 | 3/1977 | Scott et al. | 15/104.04 |
| 4,372,003 | 2/1983 | Toelke | 15/88 |

FOREIGN PATENT DOCUMENTS

| | | | |
|---|---|---|---|
| 831797 | 1/1970 | Canada | 15/104.03 |

*Primary Examiner*—Edward L. Roberts
*Attorney, Agent, or Firm*—Fulbright & Jaworski

[57] ABSTRACT

A power actuated cleaner for cleaning the threads on the ends of tubular members including a housing having a rotatable disc in the housing with power means connected to the disc for rotating the disc. A plurality of cleaning brushes are provided, each of which is connected to one of a plurality of brush adjusting arms. The brush arms are pivotally connected to the disc with a releasable connection between the adjusting arms and the disc whereby the arms may be rotated on the disc for moving the brushes for coacting with different sized pipe. The housing includes an opening at one end with a plurality of guide adjusting arms, each of which supports a guide support for a pipe, pivotally connected to the housing about the opening. A releasable connection between the adjusting arms and the housing allows the guide arms to be rotated on the housing for guiding and aligning different sized pipe into the opening. Coacting indicators are positioned between the brush adjusting arms and the disc and between the guide adjusting arms and the housing indicating the adjusted position of the arms. A conduit extends from the outside to the inside of the housing and is carried by the rotatable disc. An air supply and a solvent supply is connected to the conduit with a valve which may be alternately actuated to spray solvent on the threads or blow cleaning air on the threads.

8 Claims, 6 Drawing Figures

10
12
14
16
18
20
22
24
26
28
32
34
36
38
40
42
44
60
62
64
66
68
70
2
3

POWER PIPE THREAD CLEANER

BACKGROUND OF THE INVENTION

Pipe, such as tubing and casing used in drilling and completing oil and gas wells, are equipped with threads at each end commonly called pin and box connections. The threads are normally coated with a grease or dope to prevent corrosion of the threads until the pipe arrives at the well site. It is the general practice to remove thread protectors from the pipe, thoroughly clean the threads, and apply the appropriate dope prior to running the pipe into a well. In the past, the threads were cleaned manually with wire brushes, solvent and wiped dry with rags. More recently, various electrical or air powered thread cleaning devices such as shown in U.S. Pat. Nos. 4,011,617 and 4,014,062 have been utilized in cleaning pipe threads.

The present invention is directed to an improved power pipe thread cleaner in which the cleaning brushes and pipe guide may be quickly and easily adjusted for cleaning various sized pipes. Indicators are provided indicating the adjusted position of the brushes and guides, and a rotatable conduit directs either cleaning solvent or air on the pipe threads.

SUMMARY

The present invention is directed to a power pipe cleaner for cleaning the threads on the ends of a tubular member including a housing with a rotatable disc in the housing. Power means are connected to the disc for rotating the disc. A plurality of cleaning brushes for cleaning the threads are provided in the housing. A plurality of brush adjusting arms, each of which supports a cleaning brush, is pivotally connected to the disc. A releasable connection, such as a pin and slot, between the adjusting arms and the disc allows the arms to be rotated on the disc for moving and positioning the brushes for coacting with different sized members.

In addition, the housing includes an opening at one end. A plurality of guide adjusting arms, each of which supports a guide support for engaging the outer diameter of the member, is pivotally connected to the housing about the opening. A releasable connection, such as a pin and slot, between the guide adjusting arm and the housing is provided whereby the guide arms may be rotated on the housing for guiding and aligning different sized members into the opening.

Yet a still further object of the present invention is wherein coacting indicators are provided between the brush adjusting arms and the disc and between the guide adjusting arms and the housing indicating the adjusted position of the arms.

Still a further object of the present invention is wherein a conduit extends from the outside to the inside of the housing and an air supply and a solvent supply is connected to the conduit. A valve is connected to the conduit and when operated in one direction sprays solvent on the threads positioned in the housing and when operated in a second direction blows air on the threads for cleaning.

Still a further object of the present invention is wherein the solvent and air conduit is connected to and is carried by the rotatable disc.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figures 1, 4:
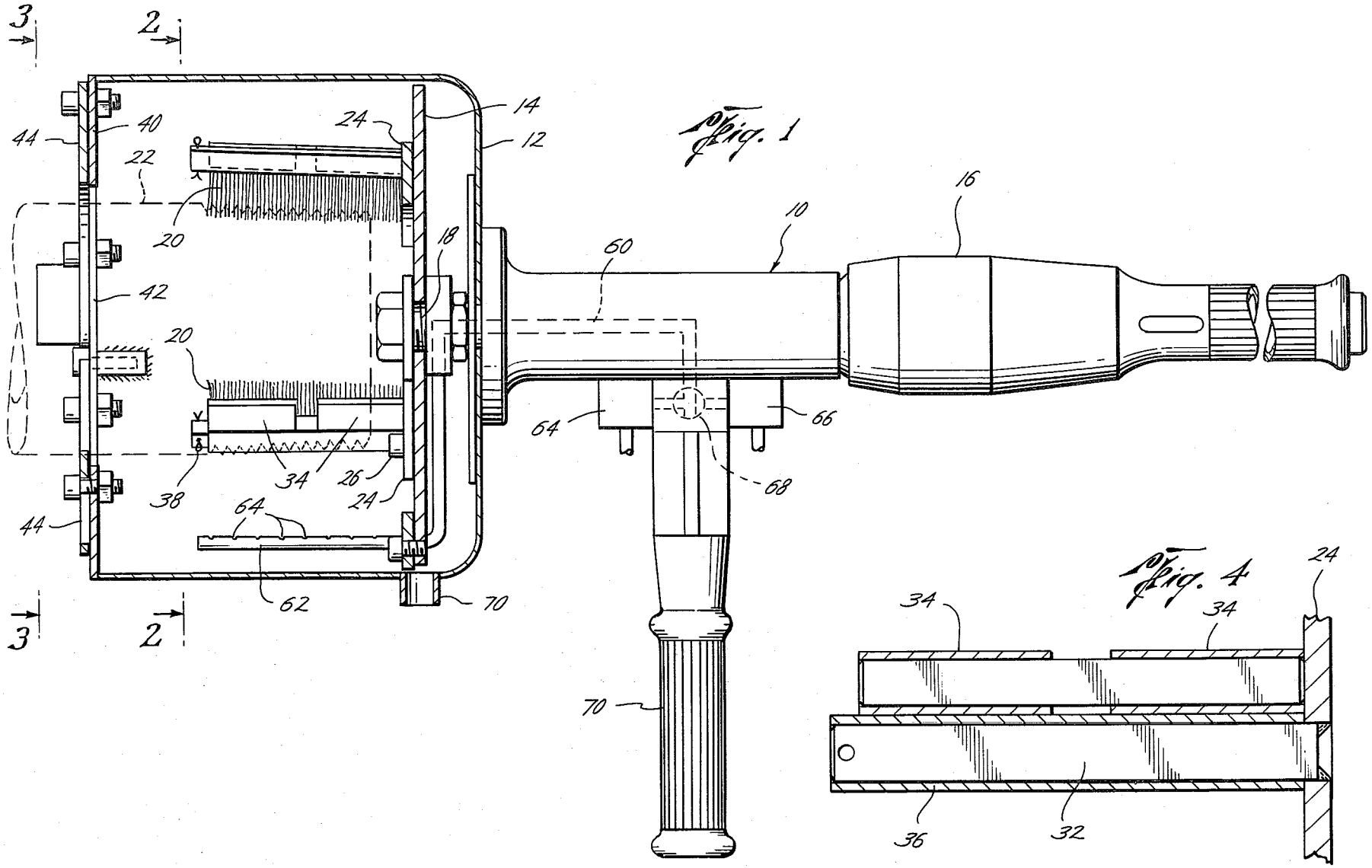
FIG. 1 is an elevational view, partly in cross section, of the apparatus of the present invention for cleaning a male thread.
FIG. 4 is a cross-sectional view taken along the line 4—4 of FIG. 2.

Referring now to the drawings, and particularly to FIG. 1, the reference numeral 10 generally indicates the power pipe thread cleaner of the present invention and generally includes a housing 12, a rotatable disc 14 in the housing 12, suitable power means, preferably an air motor 16, connected to the disc 14 through a shaft 18 for rotating the disc 14, and a plurality of cleaning brushes 20 for cleaning the threads on the ends of a tubular member or pipe 22 shown in dotted outline.

Figure 2:
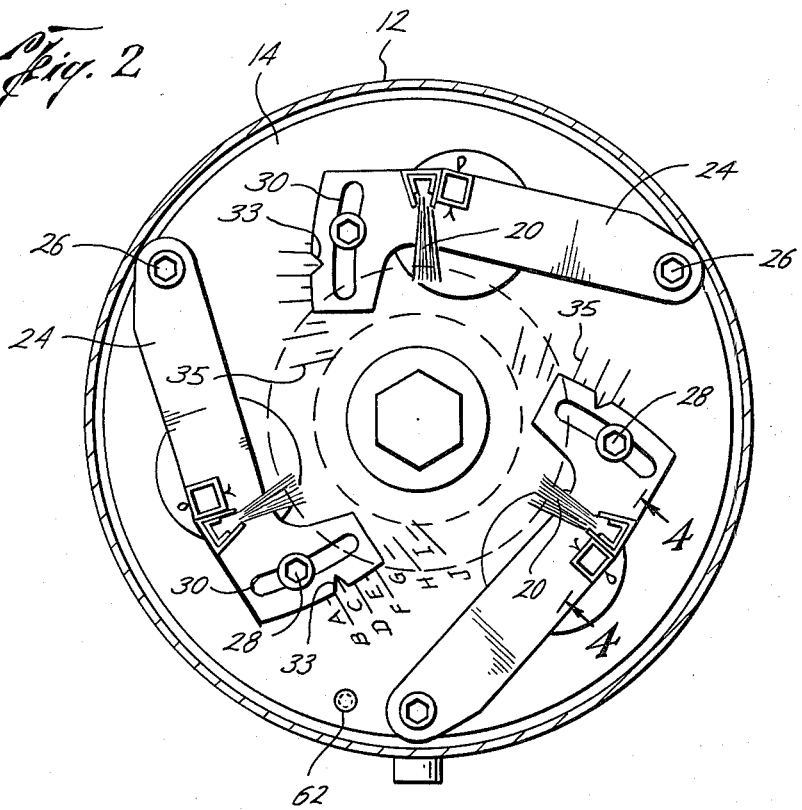
FIG. 2 is a cross-sectional view taken along the line 2—2 of FIG. 1.

As best seen in FIGS. 1 and 2, a plurality of brush adjusting arms 24, each of which supports one of the cleaning brushes 20, is pivotally connected to the disc by a cap screw 26, whereby rotation of the arms 24 will carry the brushes 20 towards and away from the tubular member 22 for cleaning the threads on different sized members 22. A releasable connection is provided between the adjusting arms 24 and the disc 14 such as a cap screw 28 and slot 30, one of which such as the screw 28 is secured to the disc 14 and the other such as slot 30 is positioned in the arm 24. Thus, by adjusting the cap screws 28 the arms 24 may be suitably adjusted and secured in different positions for cleaning the threads on different sized members 22.

Coacting indicators are provided between the brush adjusting arms 24 and the disc 14 for suitably adjusting the position of the brushes 20 for particularly sized pipe members 22. For example, the arms 24 may include an indicating V-notch 33 and the disc may include a plurality of indicator lines 35 having individual coded symbols such as A through J. For example, with the V-notches 33 adjacent the indicator lines 35 designated C the brushes 20 may be positioned for coacting with a four-inch external upset (EU) size pipe. Therefore, the adjusting arms 24 and brushes 20 may be suitably positioned to coact with a particular size pipe member 22 by merely loosening the cap screws 28, rotatably adjusting the arms 24 and retightening the cap screws 28 after aligning the V-notch 33 with the proper indicator line 35. It is further noted that the adjusting arms 24 need not be disassembled in order to provide the desired adjustment.

Referring now to FIGS. 1, 2 and 4, the brushes 20 are releasably secured to the adjusting arms 24 for ease of replacement. A support arm 32, preferably square in cross section, is secured to each of the adjusting arms 24. One or more standard strip brush clips 34 are provided with a tube 36 shaped to coact with the support 32 whereby the clips 34 may be slid onto or off of the support 32. The tube 36 is secured into position on the support 32 by connecting means such as a cotter pin 38.

Figure 3:
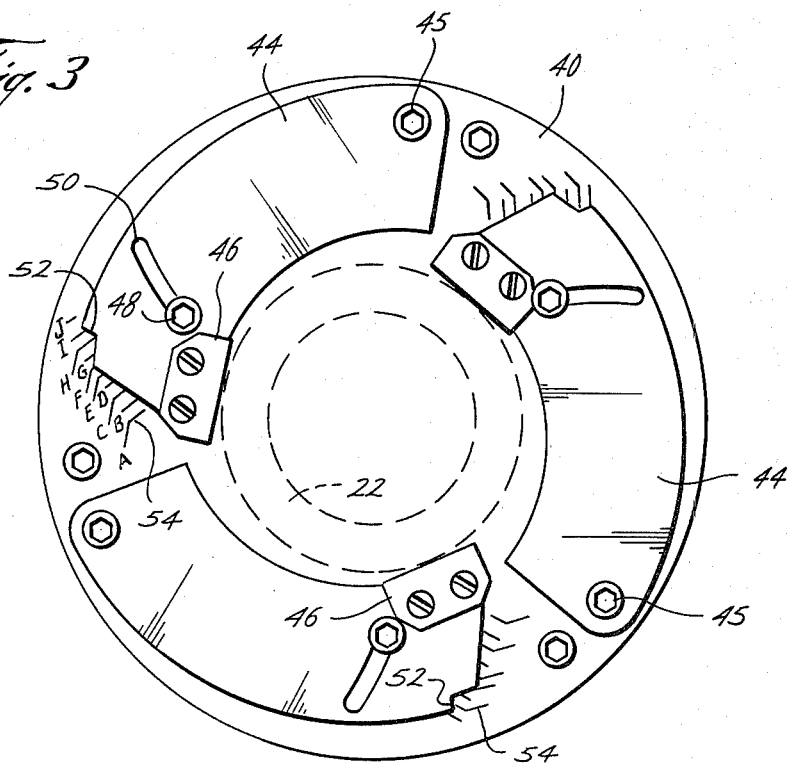
FIG. 3 is a cross-sectional view taken along the line 3—3 of FIG. 1.

The housing 12, as best seen in FIGS. 1 and 3, includes at one end a flange 40 having an opening 42 therein to receive tubular members 22. A plurality of guide adjusting arms 44, each of which supports a guide support 46, are pivotally connected to the housing flange 40 by pins 45 about the opening 42. Therefore, the guide arms 44 may be moved towards and away from the center of the opening 42 for moving the guide supports 46 into position for aligning and guiding different sized tubular members 22 into the opening 42. That is, the guide supports 46 are positioned to engage the outer diameter of the tubular member 22 and align it within the housing 12 whereby the rotating cleaning brushes 20 will rotate around the axis of the tubular member 22. A releasable connection is provided between the guide arms 44 and the housing 12 for adjusting and holding the guide arms 44 in the desired position. The adjustment means may include a cap screw 48 and slot 50 connection one of which is on the flange 40 and the other is connected to the arms 44 adjustably positioning the guide arms 44. If desired, the guide supports 46 may be omitted and the adjusting arms 44 can serve as the guides.

Coacting indicators are provided between the guide adjusting arms 44 and the housing flange 40 which may be similar to those used with the brush adjusting arms 24. Thus, one indicator is positioned on the guide arms 44 such as a V-groove 52 and a plurality of line indicators 54 may be provided on the flange 40. As indicated in FIG. 3, the V-groove is aligned with the indicator line I which may be the code for a four and one-half inch non-upset (NU) tubing male thread.

Referring now to FIGS. 1 and 2, a conduit 60 is provided through the rotating shaft 18 of the disc 14 and extends into the housing 12 to a conduit 62 which is supported by and carried by the rotatable disc 14 around the outer periphery of the tubular member 22. The conduit 62 includes spray openings 64. The passageway 60 is connected to a solvent supply 64 and also to an air supply 66. A valve 68 controlled by handle 70 may be actuated in one direction to permit solvent to flow through the passageway 60, conduit 62 and discharge on the pipe threads as the brushes 20 are rotated on the pipe. Actuation of the handle 70 in another direction causes the valve 68 to deliver compressed air from the supply 66 through the passageway 60 and conduit 62 for blowing the threads free of solvent and debris after cleaning by the brushes 20 has been completed.

Figure 5:
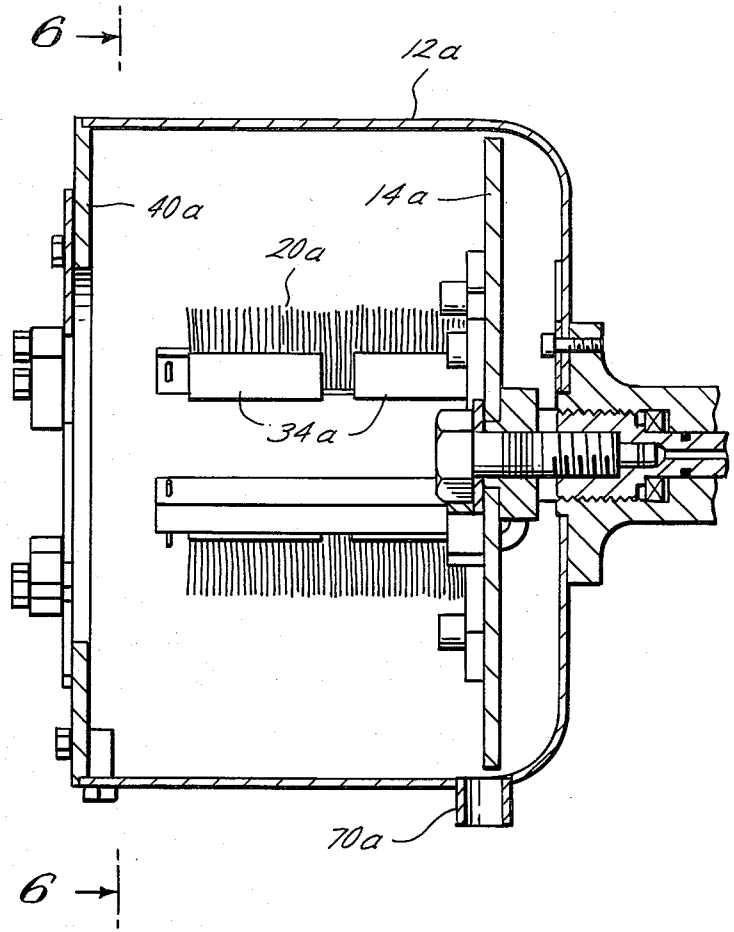
FIG. 5 is a fragmentary elevational view, partly in cross section, of the apparatus of the present invention for cleaning a female thread.
Figure 6:
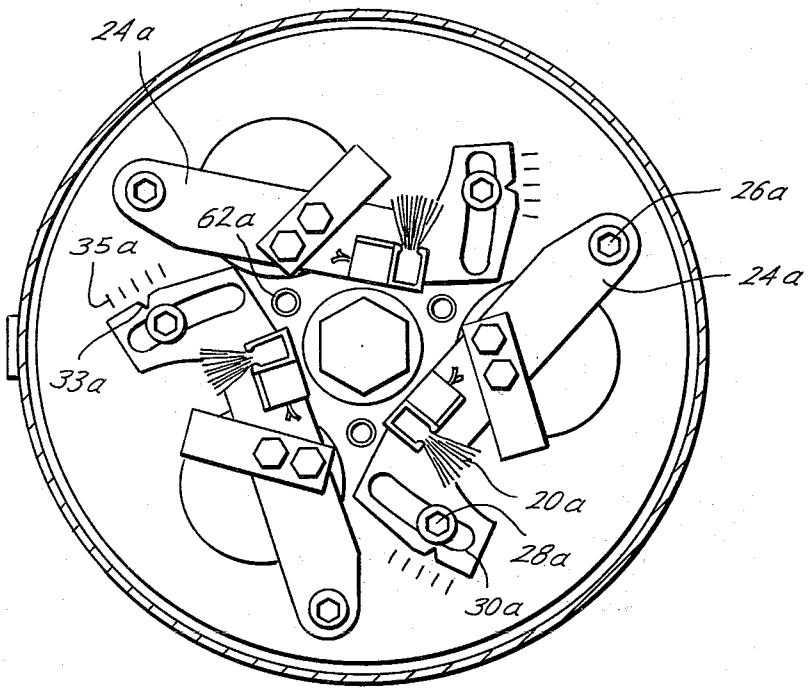
FIG. 6 is a cross-sectional view, taken along the line 6—6 of FIG. 5.

The structure shown in FIGS. 1–4 shows the arrangement of the brushes 20 for cleaning male pipe members on the tubular member 22. For cleaning female threads on the box member of a tubular member, the embodiment of FIGS. 5 and 6 may be used where like parts are similarly numbered to those in FIGS. 1–4 with the addition of the suffix "a". In this embodiment, the brushes 20*a* are facing outwardly to engage the internal threads and are mounted on adjusting arms 24*a* on a disc 14*a*. The arms 24*a* may have the same type of adjustment means such as screws 28*a* and slots 30*a*, and the same type of indicating means such as V-notches 33*a* and indicator lines 35*a*. However, the conduits 62*a* are connected to the disc 14*a* at a position to spray the internal threads.

In use, the operator adjusts the brush adjusting arms 24 and the guide adjusting arms 44 by rotating them to the proper indicating line for the sized pipe to be cleaned. The pipe 22 is then inserted into the opening 42 between the guide supports 46 and into position in the housing 12 between the brushes 20. The motor 16 is actuated turning the disc 14 and rotating the brushes 40 over the threads. In addition, the valve 70 may be actuated to spray solvent onto the threads for additional cleaning. After the cleaning is accomplished, which generally takes no more than 30 seconds, the valve 70 is moved to another direction to shut off the solvent flow and to blow air onto the threads for blowing off any debris and excess solvent.

The housing 12 also includes an outlet 70 which may be attached to a flexible hose to drain the solvent and debris removed from the pipe threads during the cleaning operation.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A cleaner for cleaning the threads on the ends of a tubular member comprising,
   - a housing,
   - a rotatable disc in the housing,
   - power means connected to the disc for rotating said disc,
   - a plurality of cleaning brushes,
   - a plurality of brush adjusting arms, each of which supports a cleaning brush, pivotally connected to the disc, a releasable connection between the adjusting arms and the disc whereby the arms may be rotated on the disc for moving the brushes for coacting with different sized members,
   - said housing having an opening at one end and a flange about said opening,
   - a plurality of guide adjusting arms pivotally connected to the housing flange about the opening, a releasable connection between the guide adjusting arms and the housing flange whereby the guide arms may be rotated on the housing flange for guiding and aligning different sized members into the opening.

2. The apparatus of claim 1 including,
   - coacting indicators between the brush adjusting arms and the disc and between the guide adjusting arms and the housing flange indicating the adjusted position of the arms.

3. The apparatus of claim 1 including a guide support connected to each guide adjusting arm.

4. The apparatus of claim 1 including,
   - a conduit extending from outside to inside of the housing,
   - an air supply and a solvent supply connected to the conduit,
   - a valve connected to the conduit and when operated in one direction sprays solvent on the threaded member positioned in the housing and when operated in a second direction blows air on said threaded member.

5. The apparatus of claim 4 wherein the conduit is connected to and carried by the rotatable disc.

6. A cleaner for cleaning the threads on the ends of a tubular member comprising, a housing, a rotatable disc in the housing, power means connected to the disc for rotating the disc, a plurality of cleaning brushes, a plurality of brush adjusting arms, each of which supports a cleaning brush, pivotally connected to the disc, a pin and slot connection between the adjusting arms and the disc whereby the arms may be rotated on the disc for moving the brushes for coacting with different sized members, said housing having an opening at one end, a plurality of guide supports for the outside of said member, a plurality of guide adjusting arms, each of which supports a guide support, pivotally connected to the housing about the opening, a pin and slot connection between the guid adjusting arms and housing whereby the guide arms may be rotated on the housing for guiding and aligning different sized members into the opening, coacting indicators between the brush adjusting arms and disc and between the guide adjusting arms and the housing indicating the adjusted position of the arms.

7. The apparatus of claim 6 including, a conduit extending from outside to the inside of the housing and carried by the rotatable disc.

8. The apparatus of claim 7 including, an air supply and a solvent supply connected to the conduit, a valve connected to the conduit and when operated in one direction sprays solvent on a threaded member positioned in the housing and when operated in a second direction blows air on said threaded member.

* * * * *